US005897164A

United States Patent [19]

Kagan et al.

[11] Patent Number: 5,897,164

[45] Date of Patent: Apr. 27, 1999

[54] BLANKET ESPECIALLY ADAPTED FOR COVERING A CHILD PLACED IN A SUPPORTING STRUCTURE OF THE TYPE HAVING AN INTERFERING OBSTRUCTION

[76] Inventors: Angela M. Kagan; Robert S. Kagan, both of Long Grove, Ill.

[21] Appl. No.: 08/818,529

[22] Filed: Mar. 14, 1997

[51] Int. Cl.[6] ..... A47G 9/04

[52] U.S. Cl. ..... 297/219.12; 2/69; 5/482

[58] Field of Search ..... 5/482, 655, 922; 297/219.12; 2/69, 69.5, 88, 89

[56] References Cited

U.S. PATENT DOCUMENTS

| | | | |
|---|---|---|---|
| 1,272,942 | 7/1918 | Goldstein | 2/88 |
| 1,704,346 | 3/1929 | Schneider | 297/219.12 |
| 3,951,127 | 4/1976 | Watson et al. . | |
| 4,125,903 | 11/1978 | Farrell | 2/69.5 |
| 4,172,300 | 10/1979 | Miller | 5/424 |
| 4,204,362 | 5/1980 | Fournier . | |
| 4,712,251 | 12/1987 | Cobble | 2/104 |
| 4,817,836 | 4/1989 | Bates | 5/98.1 |
| 4,993,090 | 2/1991 | Ranalli | 5/482 |
| 5,042,090 | 8/1991 | Cook | 2/69 |
| 5,046,204 | 9/1991 | Mohler | 5/494 |
| 5,058,226 | 10/1991 | Crosby | 5/482 |
| 5,159,727 | 11/1992 | McCracken | 5/655 |
| 5,208,926 | 5/1993 | Stackhouse | 5/482 |
| 5,243,724 | 9/1993 | Barnes | 5/482 |
| 5,309,586 | 5/1994 | Sies et al. | 5/482 |
| 5,432,965 | 7/1995 | Espinoza | 5/482 |
| 5,555,577 | 9/1996 | Volpe | 5/93.1 |
| 5,611,095 | 3/1997 | Schneider | 5/482 |

FOREIGN PATENT DOCUMENTS

| | | | |
|---|---|---|---|
| 2176998 | 1/1987 | United Kingdom | 5/482 |

*Primary Examiner*—Alex Grosz
*Attorney, Agent, or Firm*—Faegre & Benson, LLP.

[57] ABSTRACT

A blanket comprising a blanket panel having an interior region, a first major surface, a second major surface, and an outer perimeter. A throat aperture is positioned in the interior region of the blanket panel, wherein said throat aperture provides open communication between the first and second major surfaces of the blanket panel. The aperture is of a sufficient size to allow the obstruction to be positioned in the throat aperture in a manner such that the obstruction can pass through the throat aperture from one major surface of the blanket panel to the other. A channel extends from the throat aperture to the outer perimeter of the blanket panel. The channel has an open configuration and a closed configuration. In the open configuration, the channel provides open communication between the outer perimeter of the blanket panel and the throat aperture to allow the obstruction to be passed through the channel and positioned in the throat aperture. In the closed configuration, open communication between the throat aperture and the outer perimeter is prevented such that, when the channel is in the closed configuration and the obstruction is positioned in the throat aperture, the blanket is secured in place around the obstruction. When used with a child supporting structure having an interfering obstruction, the blanket covers the child in a manner such that the obstruction is positioned in the throat aperture, and the channel is in the closed configuration.

51 Claims, 13 Drawing Sheets

BLANKET ESPECIALLY ADAPTED FOR COVERING A CHILD PLACED IN A SUPPORTING STRUCTURE OF THE TYPE HAVING AN INTERFERING OBSTRUCTION

FIELD OF THE INVENTION

This invention is in the field of blankets for covering a young child. More specifically, this invention relates to a blanket having a structure which allows the blanket to effectively cover a child placed in a supporting structure (such as a swing seat, a high chair, a car seat, a bouncie seat, and the like) having an interfering obstruction.

BACKGROUND OF THE INVENTION

Young children, particularly infants, are often placed in child support structures of the type having an obstruction which projects upward between the legs of the child. These obstructions primarily serve a safety function of helping to restrain the child in the device. For example, in some structures, such as infant car seats and the like, the obstruction is primarily a safety device in the form of a restraining belt which passes between the legs of a child when the restraining belt is operationally inserted into and engaged with a corresponding restraining belt mechanism. In other structures, the obstruction serves multiple purposes. For example, for structures such as infant swing seats and high chairs, the obstruction is in the form of a post projecting upward from a seating or reclining surface. Such posts not only serve the safety function of helping to restrain an infant in these devices, but also serve to support table tops which can be used to hold food items or toys within easy reach of an infant.

FIG. 1 shows one such structure 10 commonly referred to as a "swing seat". Swing seats such as structure 10 are widely available and extremely popular. Structure 10 has a fairly typical construction sharing several common elements with many commercially available swing seats. Generally, structure 10 includes child supporting structure 12 having a seating surface 14 for supporting a young child. Child supporting structure is swingingly supported from top frame piece 18 by an interconnecting structure which, in this embodiment, includes U-shaped support member 16 and members 20. Top frame piece 18 itself is supported upon four legs 22. The legs 22 are braced by crosspiece member 24. The interconnecting structure couples the child supporting structure 12 to the top frame piece 18 in a manner which allows child supporting structure 12 to swing back and forth between legs 22. Commonly, top frame piece 18 houses a battery-powered or electric motor which is operationally coupled to members 20 in a manner which imparts the swinging motion to child supporting structure 12.

The swinging motion of child supporting structure 12 is quite soothing for many children. However, the motion generates a breeze that can be uncomfortably cool for a child, particularly if the child is just an infant. Additionally, other drafts from other sources, e.g., windows, doorways, ventilation ducts, and the like, can add to this discomfort. Thus, it is desirable to cover a child supported in structure 10 with a blanket to keep the child warm and to protect the child from breezes, drafts, and the like.

Ordinary blankets are not very effective for this purpose, because it is difficult to fit an ordinary blanket around an obstruction such as post 26. Typically, an ordinary blanket has to be bunched up and stuffed around the post in an effort to cover as many parts of the child as possible. However, it is not uncommon for some parts of the child to be uncovered with this approach. Additionally, blanket bunching leaves gaps between the blanket and the child supporting structure 12 through which cool air can reach the child. A bunched up blanket is also not very secure. Such blankets can accidentally fall out of position. Alternatively, such blankets can be knocked out of place by movements of the child. Further, a sleeping child can be inadvertantly awakened by blanket bunching. Not just swing seats, but any child supporting structure having an obstruction which interferes with placement of a blanket over a child suffers from these same drawbacks.

What is needed in the art, therefore, is a better way to keep a child warm when the child is supported in a device having such an obstruction.

SUMMARY OF THE INVENTION

The present invention provides an improved blanket which easily and securely covers a child placed in a child supporting structure of the type having an obstruction which would interfere with placement of an ordinary blanket. Whereas ordinary blankets must be bunched up to cover a child placed in such devices, the blankets of the present invention can be laid flat over the child to keep the child warm and to keep out drafts. When put in place, not only do the blankets of the present invention lie flat, but the blankets effectively "grip" the interfering obstruction, preventing the blanket from falling away from the child. The blankets of the present invention can be used with a wide variety of such child supporting structures, including but not limited to swing seats, high chairs, bouncie seats, car seats, and the like.

In one aspect, the present invention provides a blanket comprising a blanket panel having an interior region, a first major surface, a second major surface, and an outer perimeter. A throat aperture is positioned in the interior region of the blanket panel, wherein said throat aperture provides open communication between the first and second major surfaces of the blanket panel. The aperture is of a sufficient size to allow the obstruction to be positioned in the throat aperture in a manner such that the obstruction can pass through the throat aperture from one major surface of the blanket panel to the other. A channel extends from the throat aperture to the outer perimeter of the blanket panel. The channel has an open configuration and a closed configuration. In the open configuration, the channel provides open communication between the outer perimeter of the blanket panel and the throat aperture to allow the obstruction to be passed through the channel and positioned in the throat aperture. In the closed configuration, open communication between the throat aperture and the outer perimeter is prevented such that, when the channel is in the closed configuration and the obstruction is positioned in the throat aperture, the blanket is secured in place around the obstruction.

In another aspect, the present invention relates to a supporting structure for a child, comprising a supporting surface on which the child can be placed; an interfering obstruction and the blanket described above. The blanket covers the child in a manner such that the obstruction is positioned in the throat aperture, and the channel is in the closed configuration.

BRIEF DESCRIPTION OF THE DRAWINGS

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF THE PRESENTLY PREFERRED EMBODIMENTS

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

Figure 2:
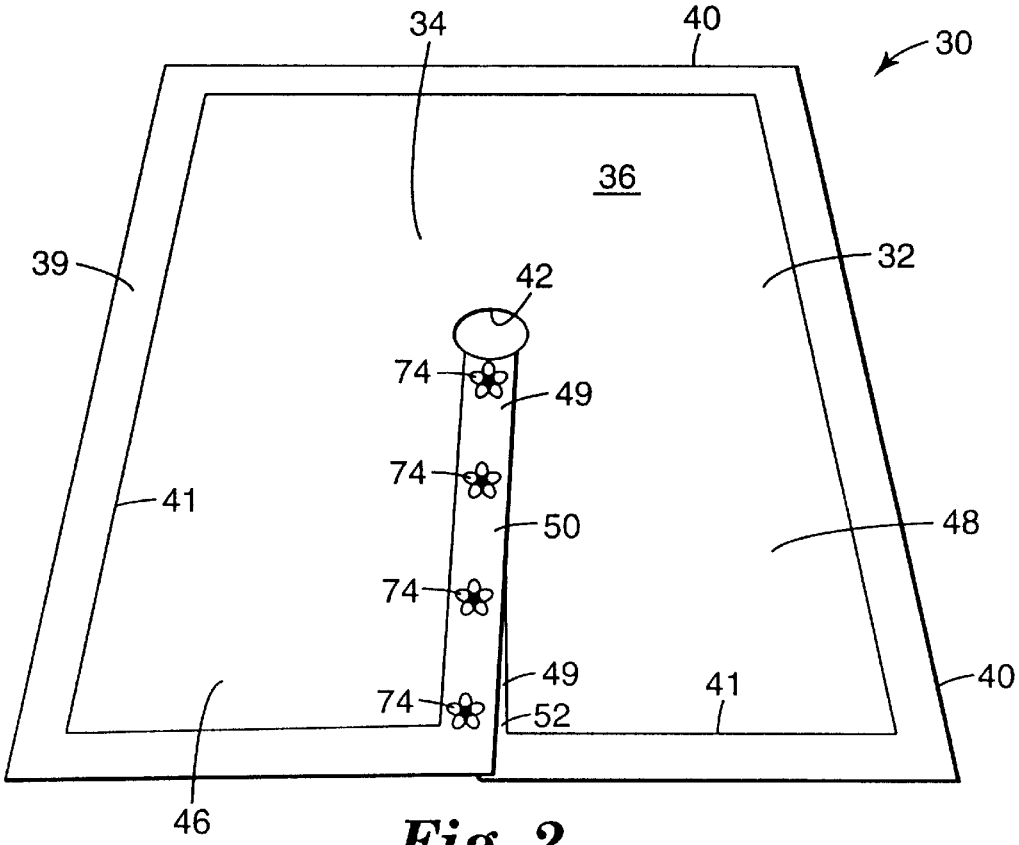
FIG. 2 is a top perspective view of one embodiment of a blanket of the present invention showing the channel in a closed configuration.
Figure 3:
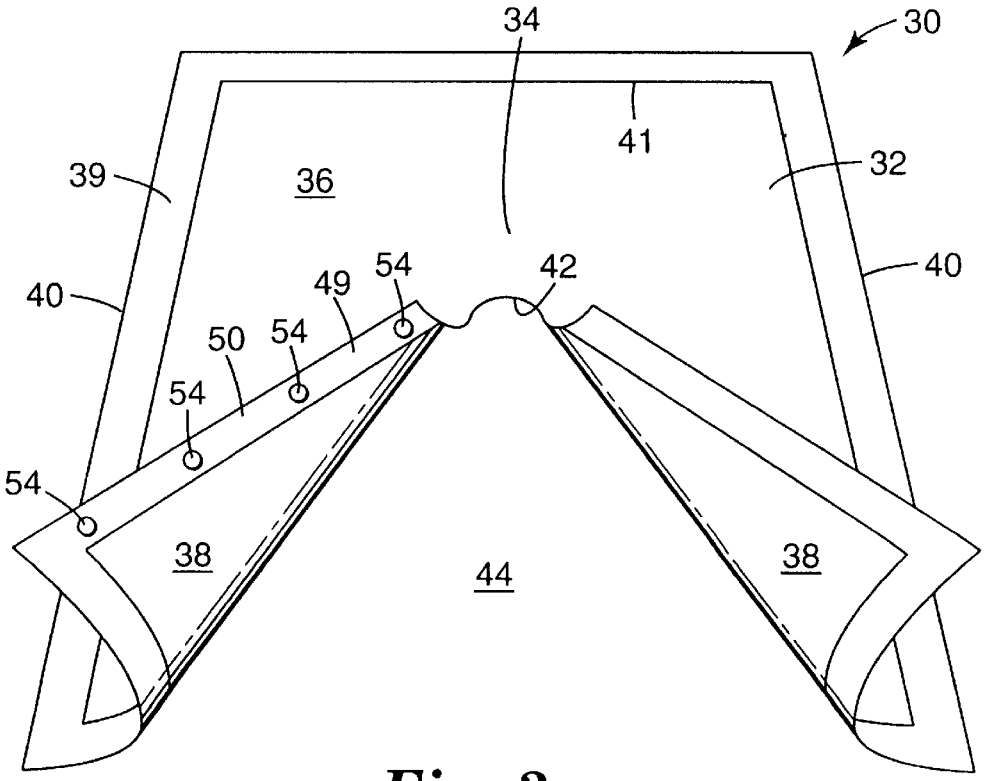
FIG. 3 is a top perspective view of the blanket of FIG. 2 showing the channel in an open configuration which allows the blanket to be easily placed around the obstruction of the baby swing seat of FIG. 1.
Figure 4:
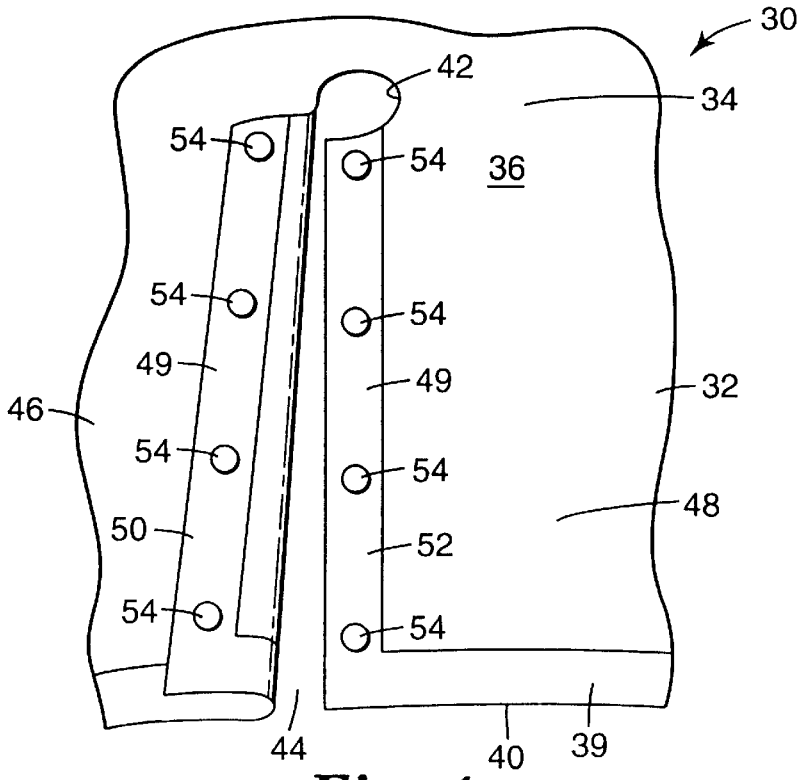
FIG. 4 is a close-up top perspective view of the blanket of FIG. 2 showing the blanket in a configuration in which the channel leading to the throat is about to be closed by securing one panel region to the other.

FIGS. 2–4 show one embodiment of a blanket 30 embodying the principles of the present invention. Blanket 30 includes a blanket panel 32 having interior region 34, first major surface 36, second major surface 38, and outer perimeter 40. In the embodiment shown, outer perimeter 40 is shown as having a rectilinear configuration such that blanket 30 is rectangular-shaped, but outer perimeter 40 could have any other configuration as desired. For example, outer perimeter could be elliptically shaped, circularly shaped, trapezoidal shaped, butterfly shaped, irregularly shaped, hexagonally shaped, or the like. The outer peripheral portion of blanket panel 32 is trimmed with blanket binding 39, which for this embodiment is preferably in the form of satin borders. The blanket binding 39 enhances the look and comfort of blanket 30. Blanket binding 39 also helps protect edges 41 of blanket panel 32 from fraying.

Figure 1:
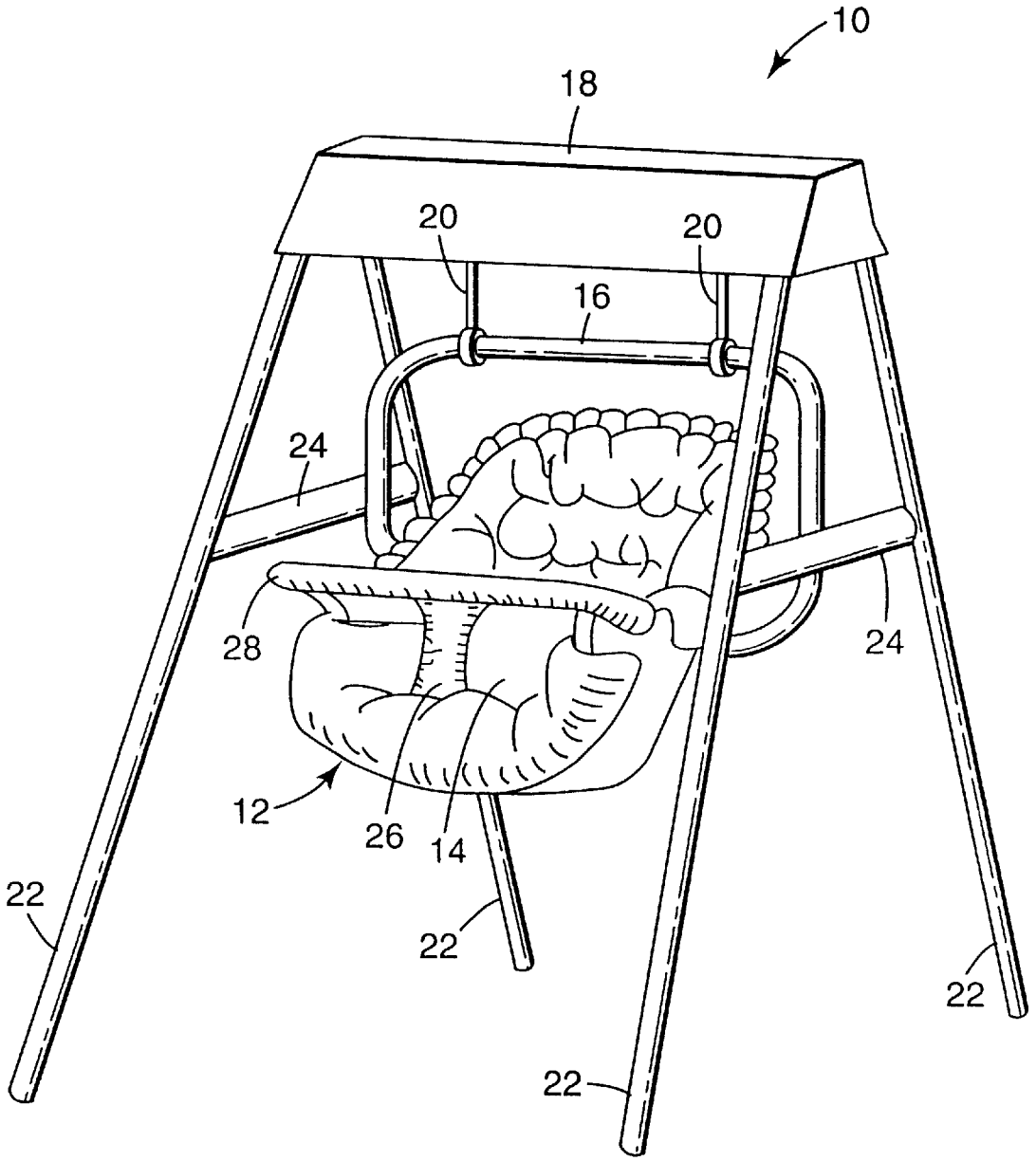
Fig. 1 PRIOR ART
FIG. 1 is a perspective view of a baby swing seat of the prior art showing the seat post which forms an obstruction between a child's legs when the child is placed in the swing seat, said seat post obstruction making it difficult to cover the child with an ordinary blanket.

Interior region 34 of blanket panel 32 includes throat aperture 42. Throat aperture 42 provides open communication between the first and second major surfaces 36 and 38. Throat aperture 42 is of a sufficient size to allow an obstruction, such as post 26 of FIG. 1, to be positioned in throat aperture 42 in a manner such that such an obstruction can pass through throat aperture 42 from one surface of blanket panel 32 to the other.

In the embodiment shown in the Figures, throat aperture 42 is circularly shaped and is substantially centrally located in the interior region 34 of blanket panel 32. Optionally, other shape configurations or locations of throat aperture 42 would be suitable in the practice of the present invention. For example, depending upon the nature of the child supporting structure with which blanket 30 is to be used, throat aperture 42 could be placed off-center to better accommodate ergonomic placement of blanket 30 around an obstruction when a child is to be covered. As another option, throat aperture 42 could be provided with alternative configurations to accommodate obstructions having different shapes. In the embodiment of FIGS. 2–4, throat aperture 42 is circularly shaped for easy placement around a cylindrically shaped obstruction such as upward projecting post 26 of FIG. 1.

Channel 44 extends from throat aperture 42 to the outer perimeter 40 of blanket panel 32. Channel 44 has an open and a closed configuration. In the open configuration, as shown best in FIGS. 3 and 4, channel 44 provides open communication between the outer perimeter 40 and throat aperture 42. This allows an obstruction to be passed through channel 44 and positioned in throat aperture 42. After such an obstruction is in position in throat aperture 42, channel 44 is closable to prevent open communication between throat aperture 42 and the outer perimeter 40. This secures blanket 30 in place around the obstruction, advantageously making it difficult for the child being covered to accidentally or intentionally kicking or otherwise knocking blanket 30 away. Advantageously, these features of the present invention make it extremely easy to cover a child placed in a support structure having an obstruction and avoids the problems of blanket bunching or secure placement suffered by ordinary blankets. Preferably, channel 44 can be opened and closed reversibly so that blanket 30 can be used to cover a child and removed as many times as desired. However, in an alternative embodiment of the present invention, in which blanket 30 is intended to be disposable, it is not as important that channel 44 be reversibly openable after channel 44 has been closed around an obstruction.

Figure 5:
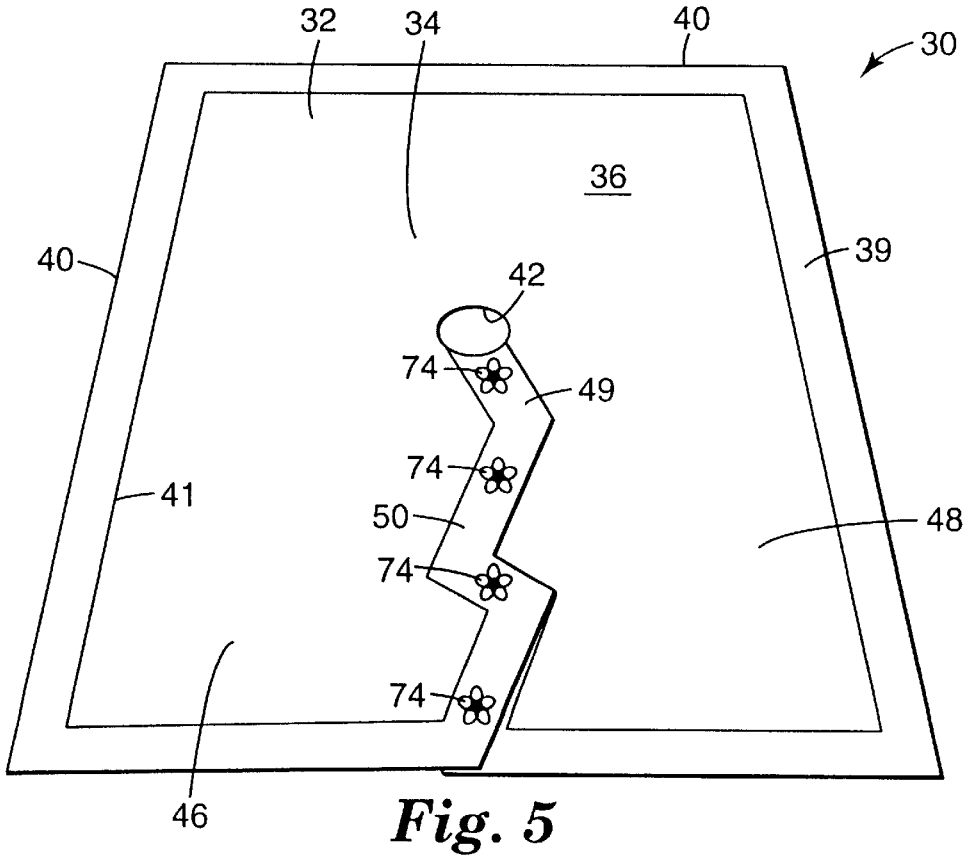
FIG. 5 shows an embodiment of the present invention including an alternative kind of fastening element for closing the blanket channel.

Channel 44 of FIGS. 2–4 as shown is substantially straight and extends in linear fashion between outer perimeter 40 and throat aperture 42. However, as an option, channel 44 could be provided with one or more bends or curves. For example, FIG. 5 shows a blanket having a zig-zag shaped channel 44. The zig-zag shape of channel 44 in this Figure makes it more difficult for blanket 30 to fall off the child in the event that channel 44 is not closed using fastening elements, as described below.

Referring again collectively to FIGS. 2–4, channel 44 defines first and second panel regions 46 and 48 positioned adjacent channel 44. As perhaps best seen in FIG. 4, at least a portion of first panel region 46 is adapted to overlap at least a portion of second panel region 48 when channel 44 is closed. To provide this overlapping capability, first panel region 46 includes an overlapping portion 50 which overlies overlapped portion 52 of second panel region 48. In a manner similar to the way in which blanket binding 39 is provided around the edges 41 of blanket panel 32, portions 50 and 52 are trimmed with blanket binding 49 adjacent channel 44. Blanket binding 49 also is preferably in the form of satin borders.

To facilitate closing of channel 44, the first panel region 46 is desirably releasably securable to second panel region 48. Preferably, first panel region 46 is securable to second panel region 48 by cooperating fastening elements 54 positioned on engaging portions of the first and second panel regions 46 and 48, respectively. In the blanket 30 of FIGS. 2–4 in which the first panel 46 overlaps second panel 48, such fastening structure is most advantageously positioned on engaging faces of the overlapping portion 50 and overlapped portion 52. In one preferred embodiment, fastening elements 54 are in the form of cooperating hook and loop fastening buttons which make it extremely fast and easy to releasably secure first panel region 46 to second panel region 48. Examples of hook and loop fastening buttons suitable in the practice of the present invention are commercially available.

Figure 6:
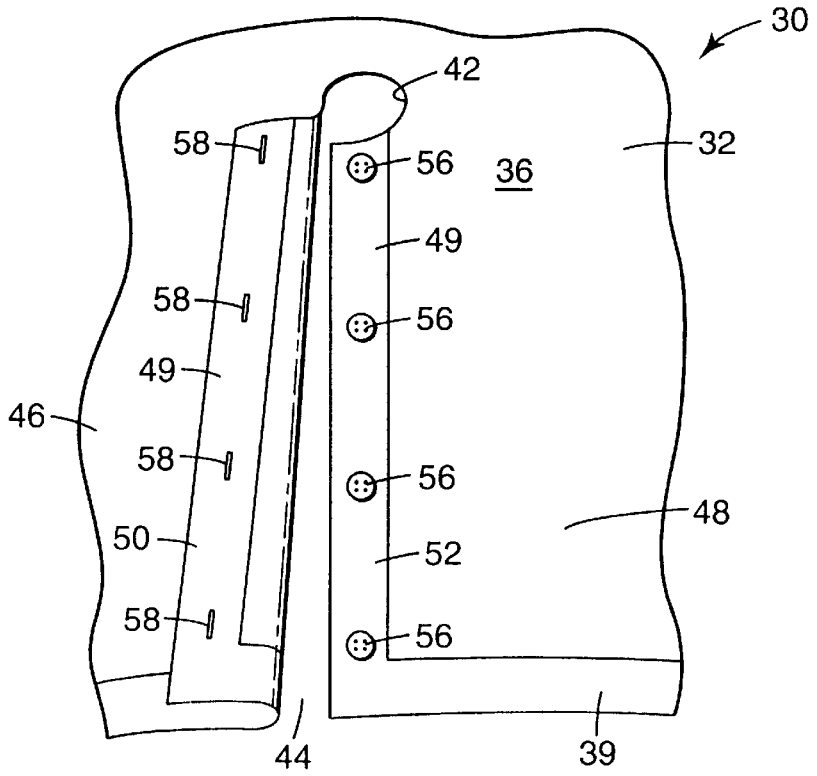
FIG. 6 shows an embodiment of the present invention including an alternative kind of fastening element for closing the blanket channel.

Such hook and loop fastening buttons are not the only fastening means which would be suitable in the practice of the present invention. Other kinds of fastening structures could be used as well. For example, the alternative embodiment of FIG. 6 shows ordinary shirt-type buttons 56 on second panel region 48 which are capable of engaging button holes 58 on first panel region 46.

Figure 7:
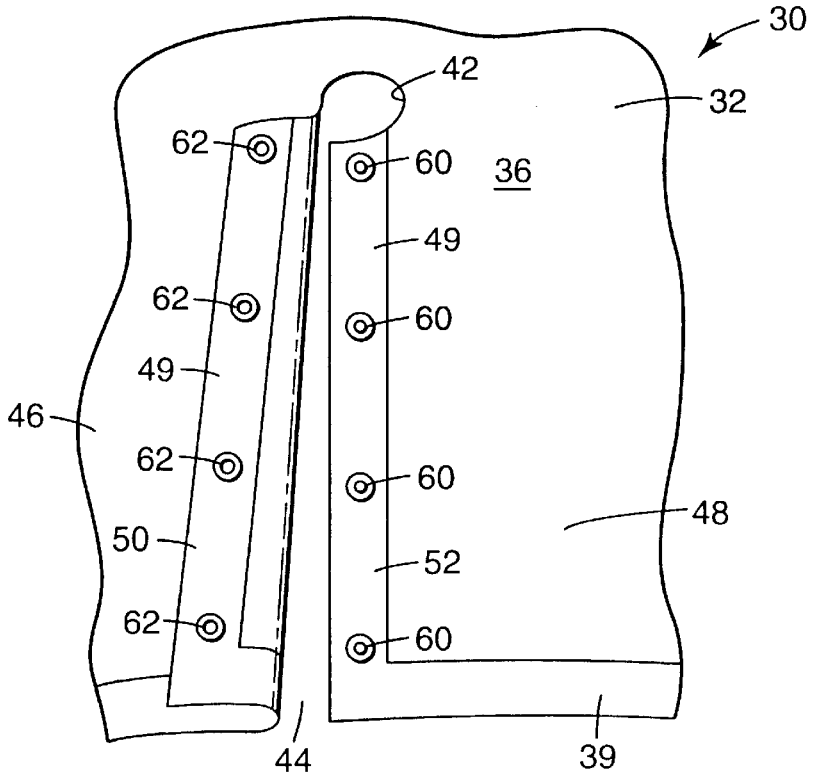
FIG. 7 shows an embodiment of the present invention including an alternative kind of fastening element for closing the blanket channel.

The alternative embodiment of FIG. 7 shows snaps 60 on second panel region 48 which are capable of engaging snap receivers 63 on first panel region 46.

Figure 8:
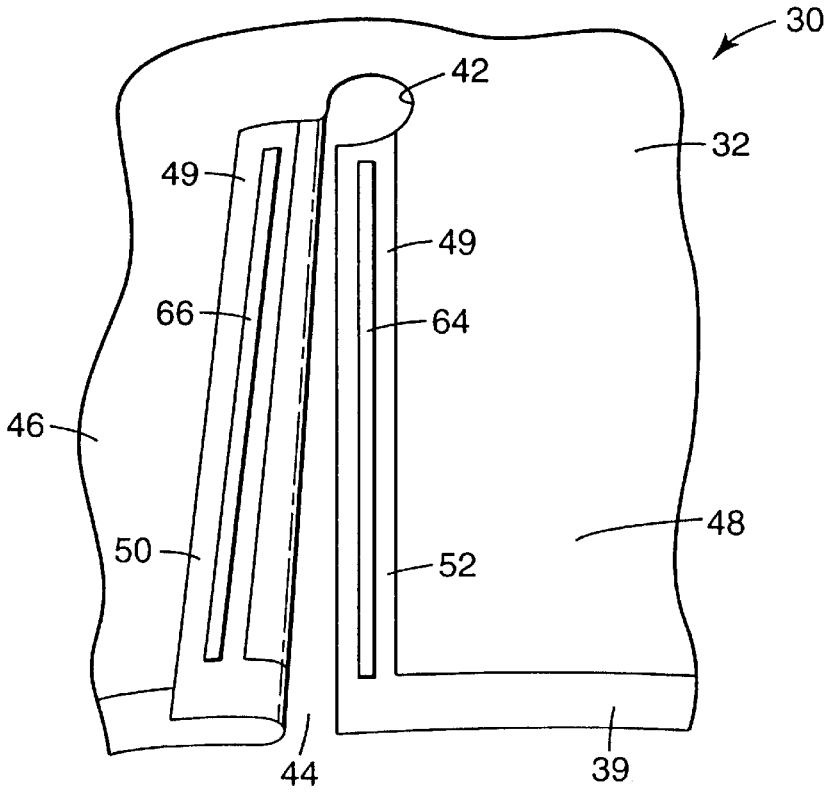
FIG. 8 shows an embodiment of the present invention including an alternative kind of fastening element for closing the blanket channel.

The alternative embodiment of FIG. 8 shows a continuous length of a hook and loop fastening strip 64 on second panel region 48 which is capable of engaging a cooperating hook and loop fastening strip 66 on first panel region 46. Generally, the hook and loop button structures of FIGS. 2–4 are more preferred as compared to the hook and loop fastening strips of FIG. 8 in that the strips 64 and 66 make much more noise when being opened. The increased noise is undesirable, because such noise increases the chances that the child being covered will be startled awake when the channel 44 is opened.

Figure 9:
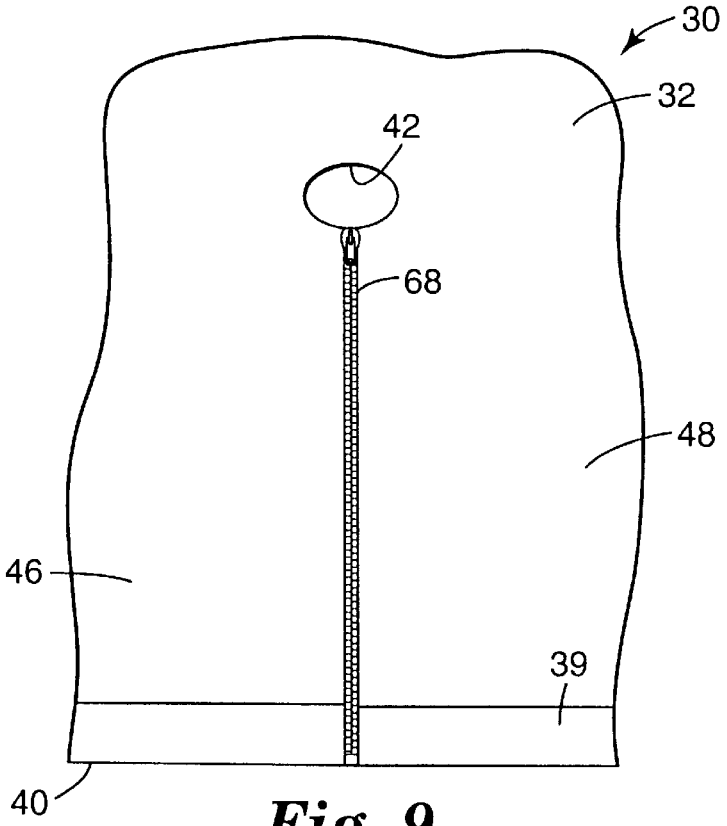
FIG. 9 shows an embodiment of the present invention including an alternative kind of fastening element for closing the blanket channel.

FIG. 9 shows an alternative embodiment in which a zipper 68 is used to secure first panel region 46 to second panel region 48. In this embodiment, rather than including overlapping and overlapped portions 50 and 52, the first and second panel regions 46 and 48 have edges 70 and 72 which are positioned adjacent each other to facilitate operative coupling to zipper 68.

Figure 10:
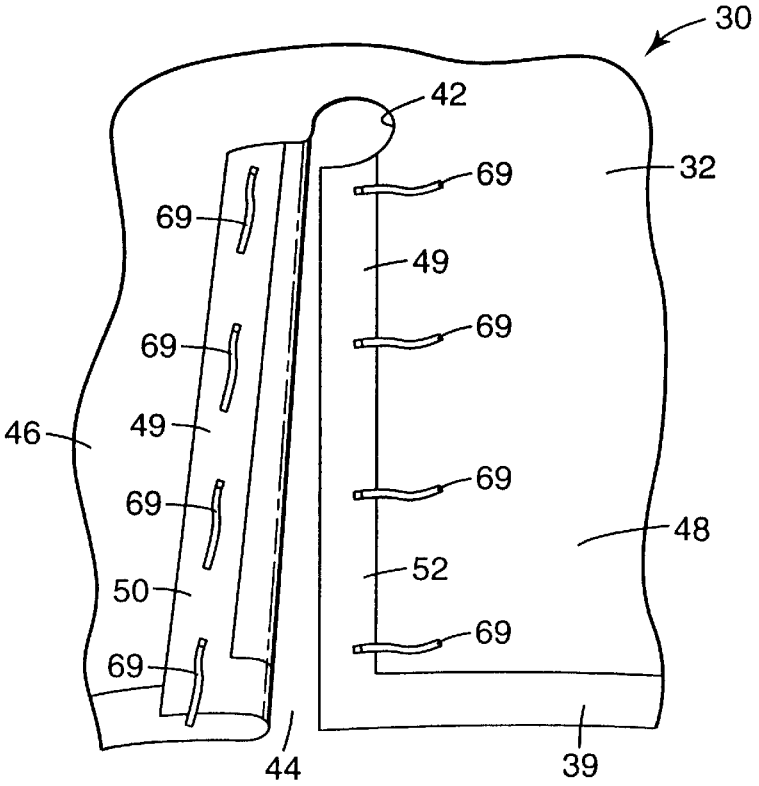
FIG. 10 shows an embodiment of the present invention including an alternative kind of fastening element for closing the blanket channel.

In the alternative embodiment of FIG. 10, strings 69 are used to tie first and second panel regions 46 and 48 together.

Figure 11:
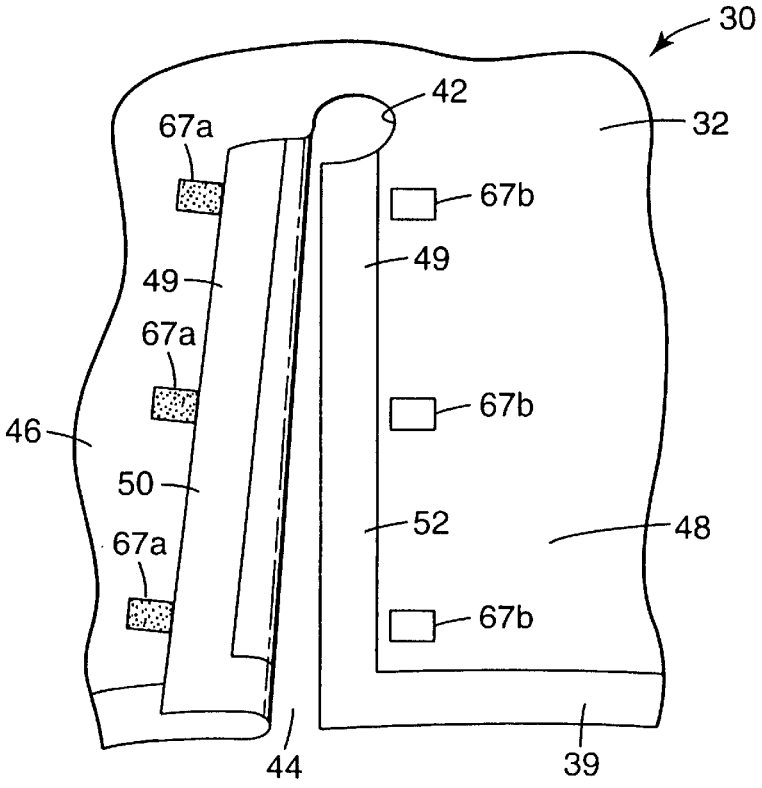
FIG. 11 shows an embodiment of the present invention including an alternative kind of fastening element for closing the blanket channel.

In the alternative embodiment of FIG. 11, adhesive tapes 67*a* secure first panel region 46 to tape receiving areas 67*b* on second panel region 48 in a manner analogous to the way in which diaper tapes are used to close diapers around an infant. The use of tapes 67*a* and tape receiving areas 67*b* is particularly useful for medical and/or health care applications in which blanket 30 is intended to be disposable after a single use.

Referring again collectively to FIGS. 2–4, it can sometimes be difficult to align and fasten the cooperating fastening elements 54 on each of first and second panel regions 46 and 48 in order to close channel 44 when fastening elements 54 are in the form of discrete, spaced apart elements such as hook and loop fastening buttons, snaps, or the like. To make such alignment easier, and as best shown in FIG. 2, visually observable registration marks 74 are preferably placed on the outer face of the overlapping portion 50 of first panel region 46 in a position juxtaposed over the fastening elements 54. Similar visually observable registration marks (not shown) may also be placed on the outer face of the overlapped portion 52 of second panel region 48 to make it easier to close channel 44 in the event that the other surface of blanket panel 32 is facing upward.

Registration marks 74 are preferably provided as elements which have a visually observable difference in color, contrast, gloss, texture, or the like as compared to surrounding portions of first and/or second panel regions 46 and 48, as the case may be. For example, according to one approach, the registration marks 74 can be provided by printing a contrasting printable medium, e.g., screen printable dye or ink, onto blanket panel 32. Another alternative is to sew a patch onto blanket panel 32. Still another alternative is to glue a patch onto blanket panel 32. Any convenient approach could be used. In FIG. 2, registration marks 74 are in the form of separately formed flowers which are made from fabric patches of contrasting colors which have been sewn in place.

Figure 12:
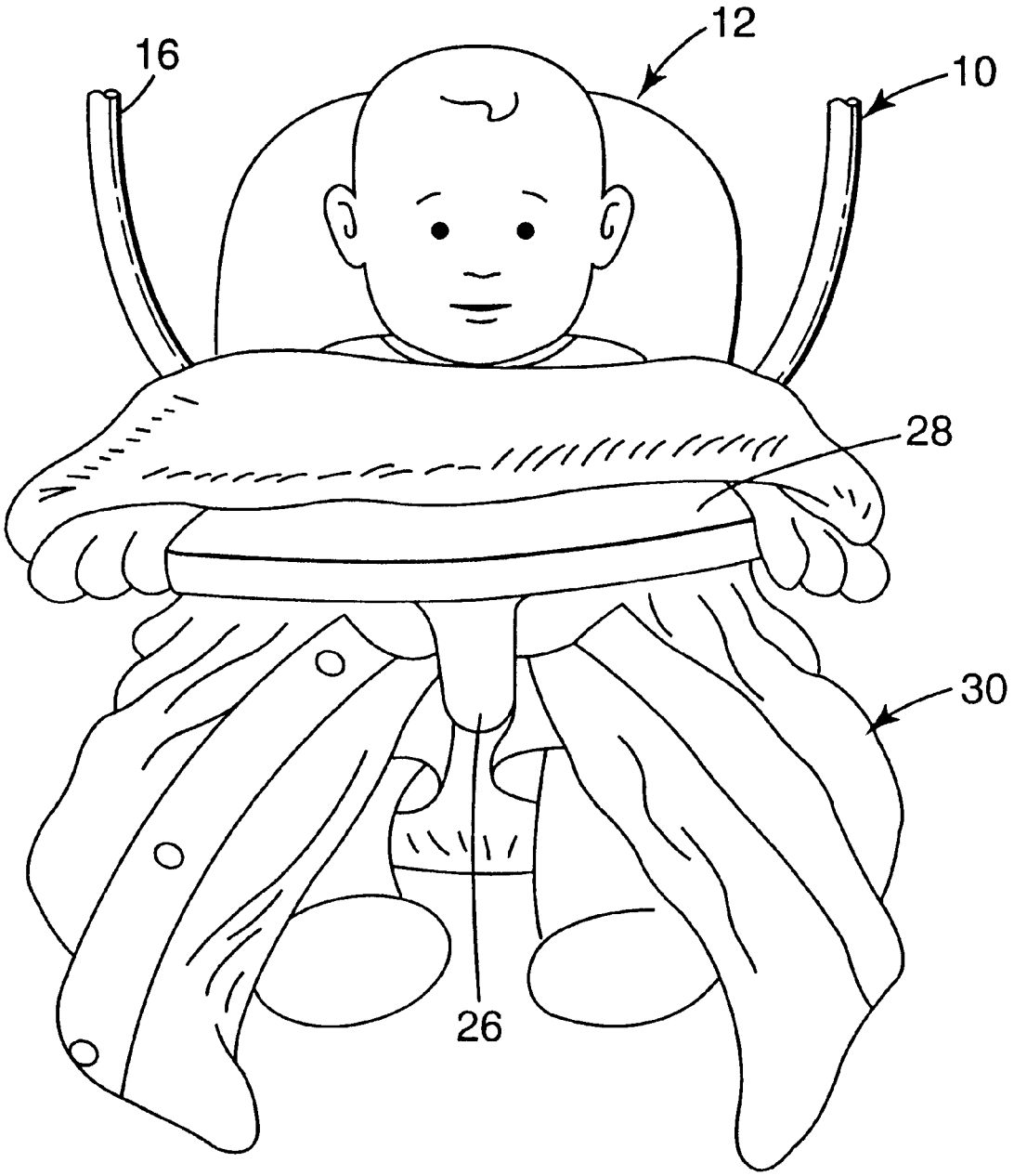
FIG. 12 is a perspective view showing the blanket of FIGS. 2–4 being placed around the seat post obstruction of the swing seat of FIG. 1 while a child is placed in the swing seat.
Figure 13:
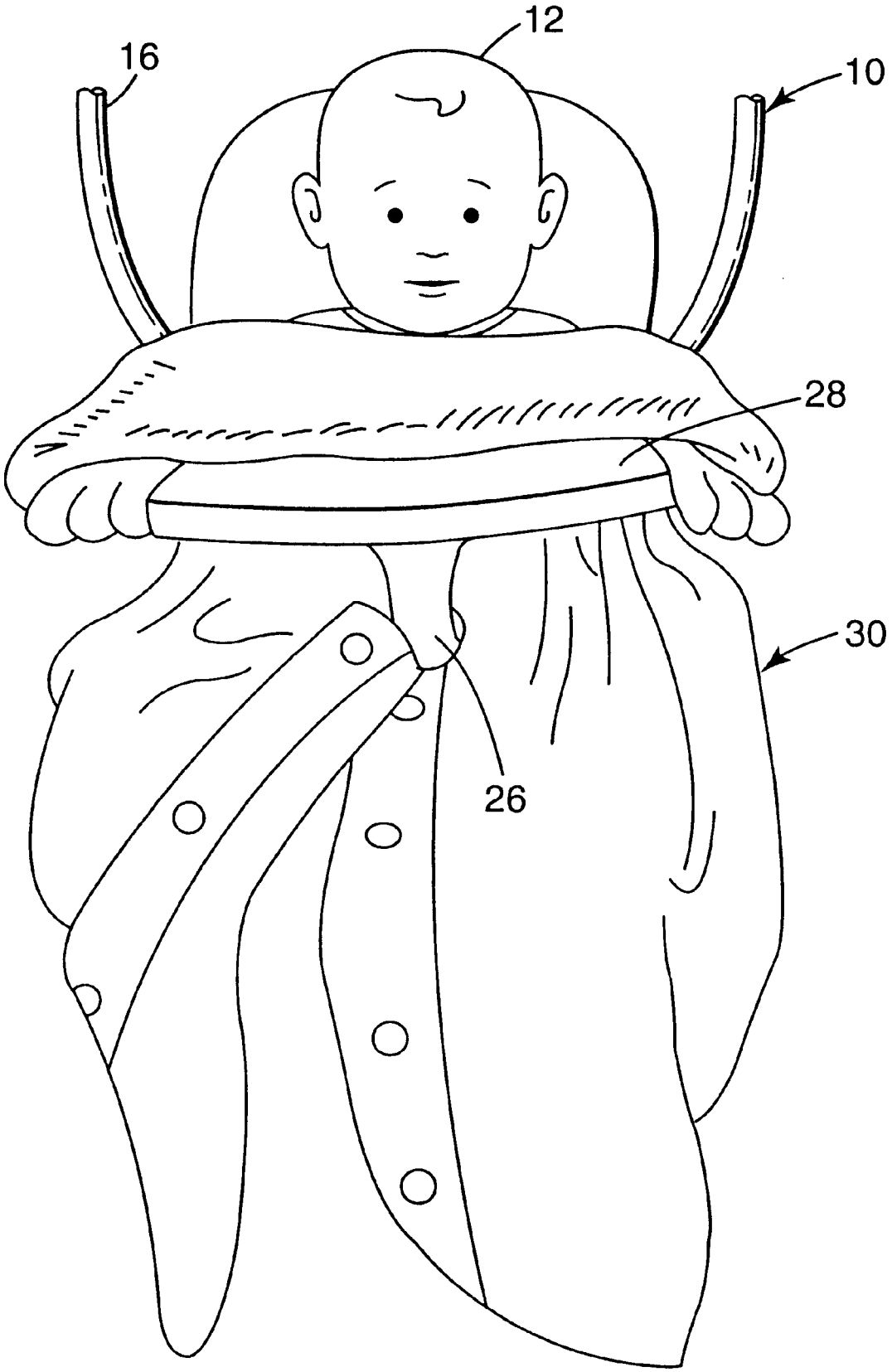
FIG. 13 is a close-up perspective view of the swing seat and blanket of FIG. 12 showing the channel of the blanket in the process of being closed.
Figure 14:
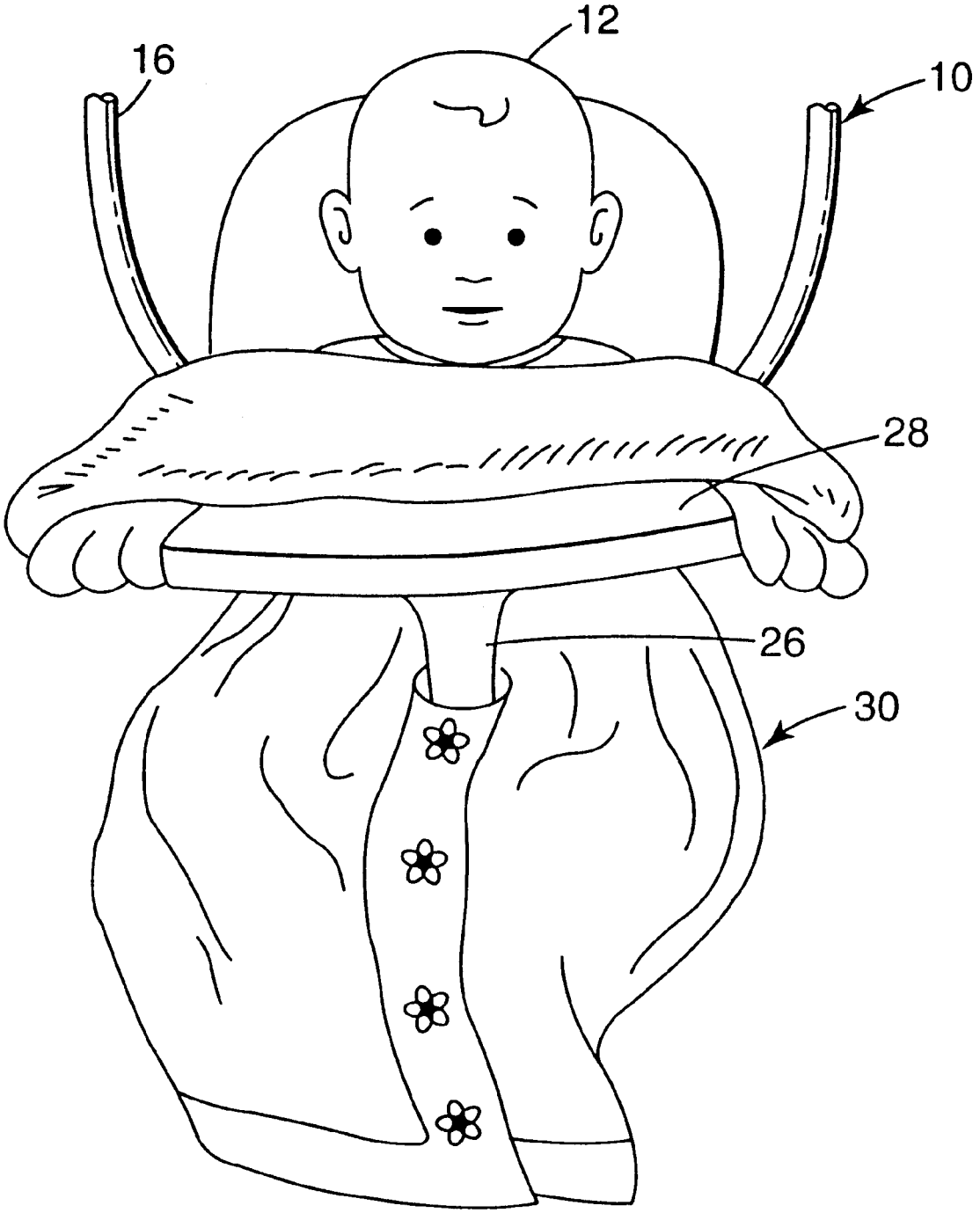
FIG. 14 is a perspective view of the child, blanket, and swing seat of FIG. 12 showing the blanket in place and the channel fully closed, thus securing the blanket in place and covering the child to keep the child warm.

The use of a blanket of the present invention will now be described with reference to FIGS. 12–14. In these Figures, the use of the present invention is shown in connection with blanket 30 of FIGS. 2–4 and swing seat 10 of FIG. 1. Referring first to FIG. 12, an infant 76 is placed onto the seating surface 14 of child supporting structure 12. The upward projecting post 26 is positioned between the infant's legs. It is this post 26 and similar obstructions in other types of seating structures (e.g., high chairs, car seats, swing seats, and the like), which make it difficult to effectively cover a young child with ordinary blankets. Once the infant 76 is placed onto the seating surface 14, blanket 30 having channel 44 in the open state is placed over the child in a manner such that post 26 is positioned in throat aperture 42.

Channel 44 may now be closed by securing first panel region 46 to second panel region 48. FIG. 13 shows a first pair of fastening elements 54 being fastened for this purpose. FIG. 14 shows blanket 30 with all fastening elements 54 fastened for completely closing channel 44. Blanket 30 now effectively covers infant 76 without any blanket bunching and without exposing infant 76 to drafts and breezes which necessarily accompany blanket bunching. Further, with channel 44 closed, blanket 30 cannot fall off of infant 76 accidently, and the blanket 30 cannot be knocked out of place by leg, arm, or body movements of infant 76 either.

Figure 15:
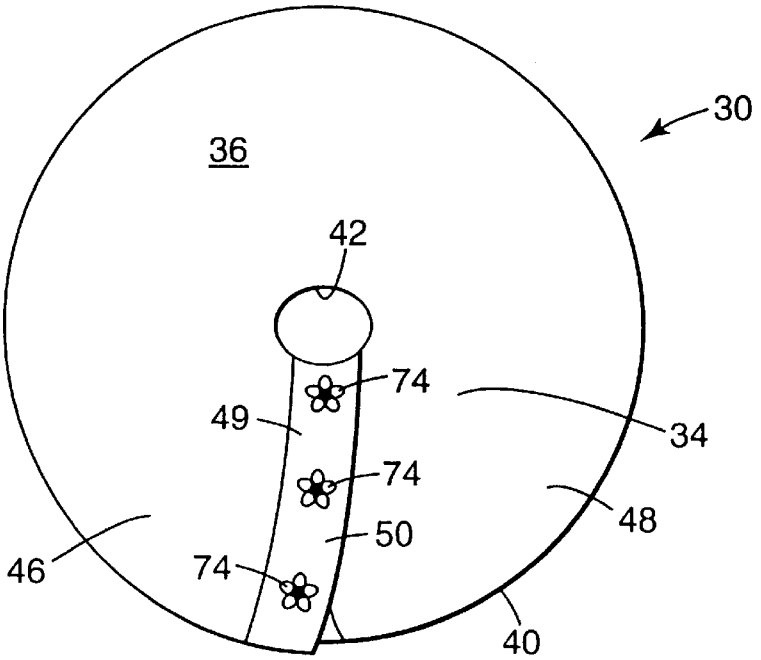
FIG. 15 is an alternative embodiment of a blanket of the present invention.
Figure 16:
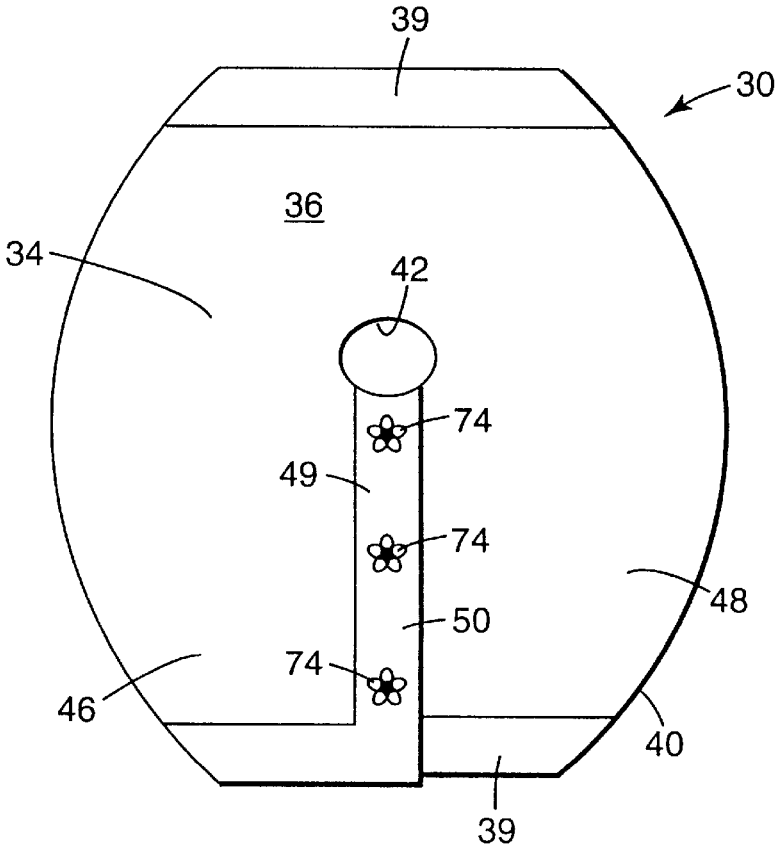
FIG. 16 is an alternative embodiment of a blanket of the present invention.

An alternative embodiment of a blanket 30 having a circularly shaped outer perimeter 40 and embodying the principles of the present invention is shown in FIG. 15. The circularly shaped outer perimeter 40 of this embodiment offers many advantages. For example, as seen best in FIG. 14, note how the corner portions of blanket 30 having a rectilinear outer perimeter 40 are not required for effectively covering infant 76, and in fact are folded back over table 28 to avoid placing too much blanket material proximal to the head of infant 76. Such folding back of the corner portions may not be desirable when food items are placed on table 28. Advantageously, blanket 30 having a circular outer perimeter 40 of FIG. 15 eliminates the extra blanket material in the corner regions of a rectangular blanket, thus avoiding the need to fold back such extra material. The same advantage could also be achieved by providing a blanket 30 with a relatively wide central interior region 34 and at least one tapered end proximal to blanket bindings 39 at ends of blanket 30 as shown in FIG. 16.

Figure 17:
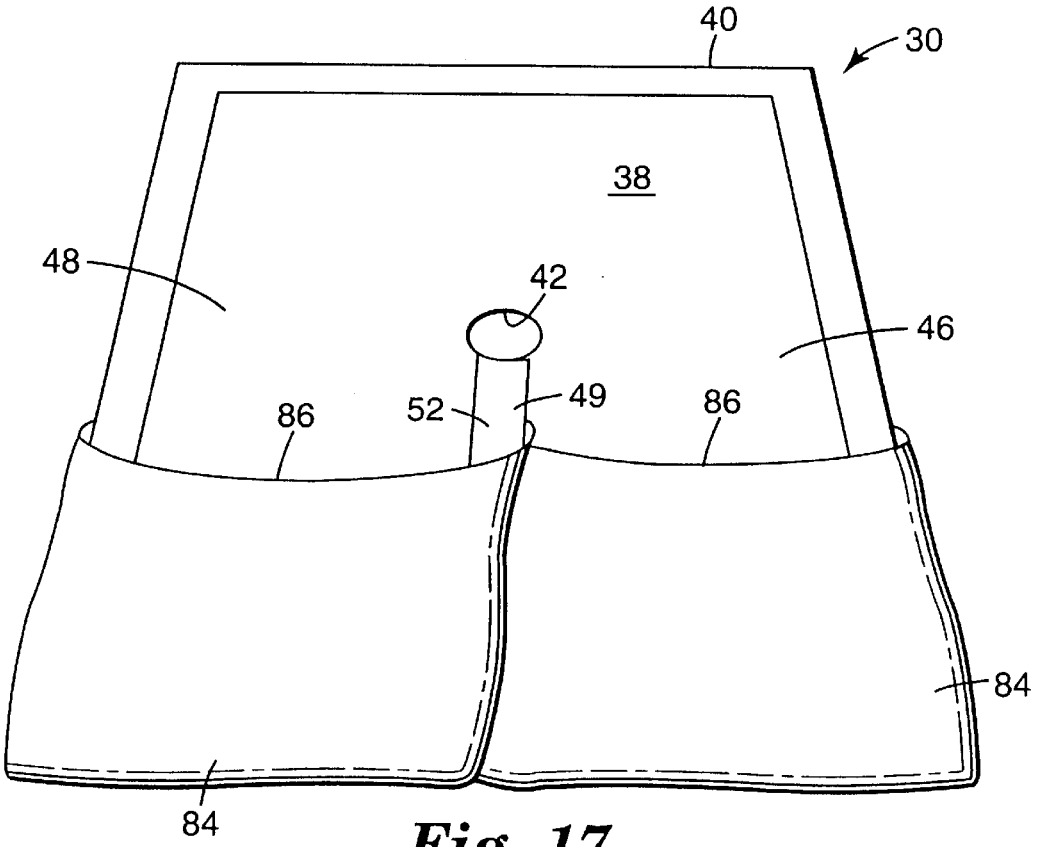
FIG. 17 is an alternative embodiment of a blanket of the present invention.

Another embodiment of the present invention is shown in FIG. 17. There, blanket 30 is identical in all respects to blanket 30 of FIGS. 2–4 except that blanket 30 of FIG. 17 includes a pair of pocket forming flaps 84 on the underside surface of first and second panel regions 46 and 48 to provide leg receiving pockets 86.

Figure 18:
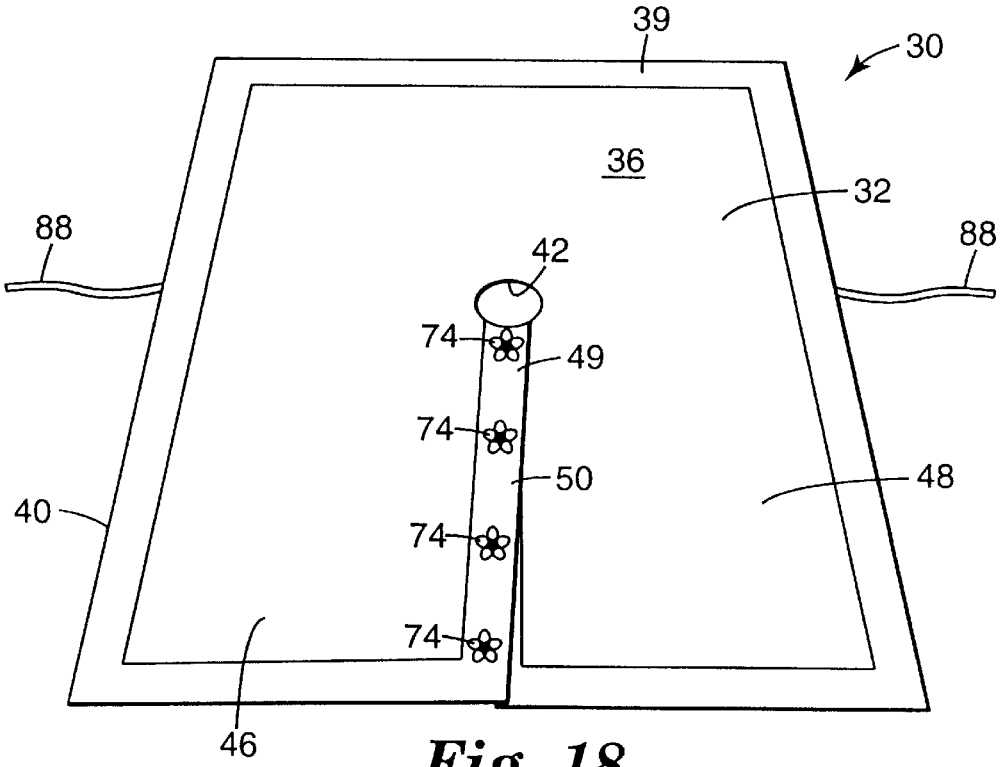
FIG. 18 is an alternative embodiment of a blanket of the present invention.

Another embodiment of the present invention is shown in FIG. 18. There, blanket 30 is identical in all respects to blanket 30 of FIGS. 2–4 except that blanket 30 of FIG. 18 includes a pair of securing members 88 extending from opposite sides of blanket 30. Securing members 88, here in the form of laces, may be used to help tie the sides of blanket 30 to the child supporting structure if desired. In alternative preferred configurations, securing members 88 may be in the form of straps with some kind of fastening elements at the end which may be looped around portions of the child supporting structure and/or associated framework if any, and fastening to cooperating fastening elements positioned on such straps or on a convenient position an blanket panel 32 itself.

Any blanket 30 of the present invention can be made from a wide variety of materials. Any material known to be suitable for forming blankets could be used as desired. Just a few examples of suitable materials include natural and synthetic fabrics or sheet goods such as wool, cotton, leather, foil, polyethylene, polyurethane, polyamide, polyimide, latex rubber, vinyl copolymer, styrene-butadiene containing polymer, polyester, paper, combinations of these materials, and the like. Blanket 30 may also be formed so that one or both surfaces 36 and/or 38 is food and/or water repellent to facilitate easy clean-up.

Figure 19:
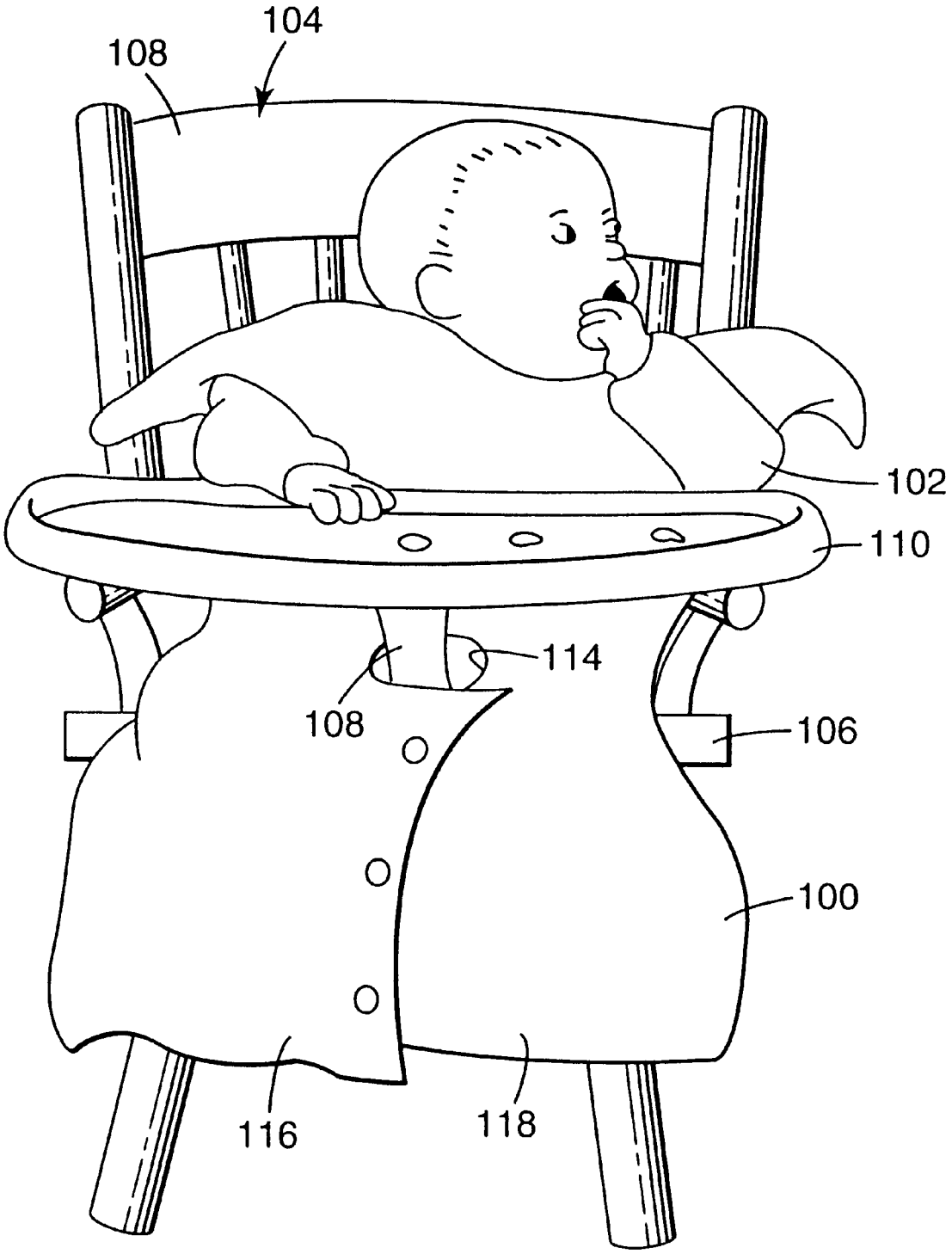
FIG. 19 is an embodiment of the present invention in which a baby blanket covers a child seated in a high chair.

FIG. 19 illustrates another embodiment of the present invention in which baby blanket 100 of the present invention covers a child 102 seated in a supporting structure in the form of high chair 104. high chair 104 includes seat 106 and seat back 108 to support child 102 sitting in high chair 104. An upward extending obstruction in the form of post 108 supports table 110. In order to keep child 102 warm and secure from drafts, blanket 100 curves around and covers child 102. Post 108 extends upward through throat aperture 114. Flap 116 is secured to flap 118 in order to secure blanket 100 in place. Flap 116 and flap 118 are easily opened to allow blanket 100 to be positioned around and removed from post 108 as desired. Advantageously, blanket 100 can be positioned over child 102 and removed without having to lift child 102 out of high chair 104.

Figure 20:
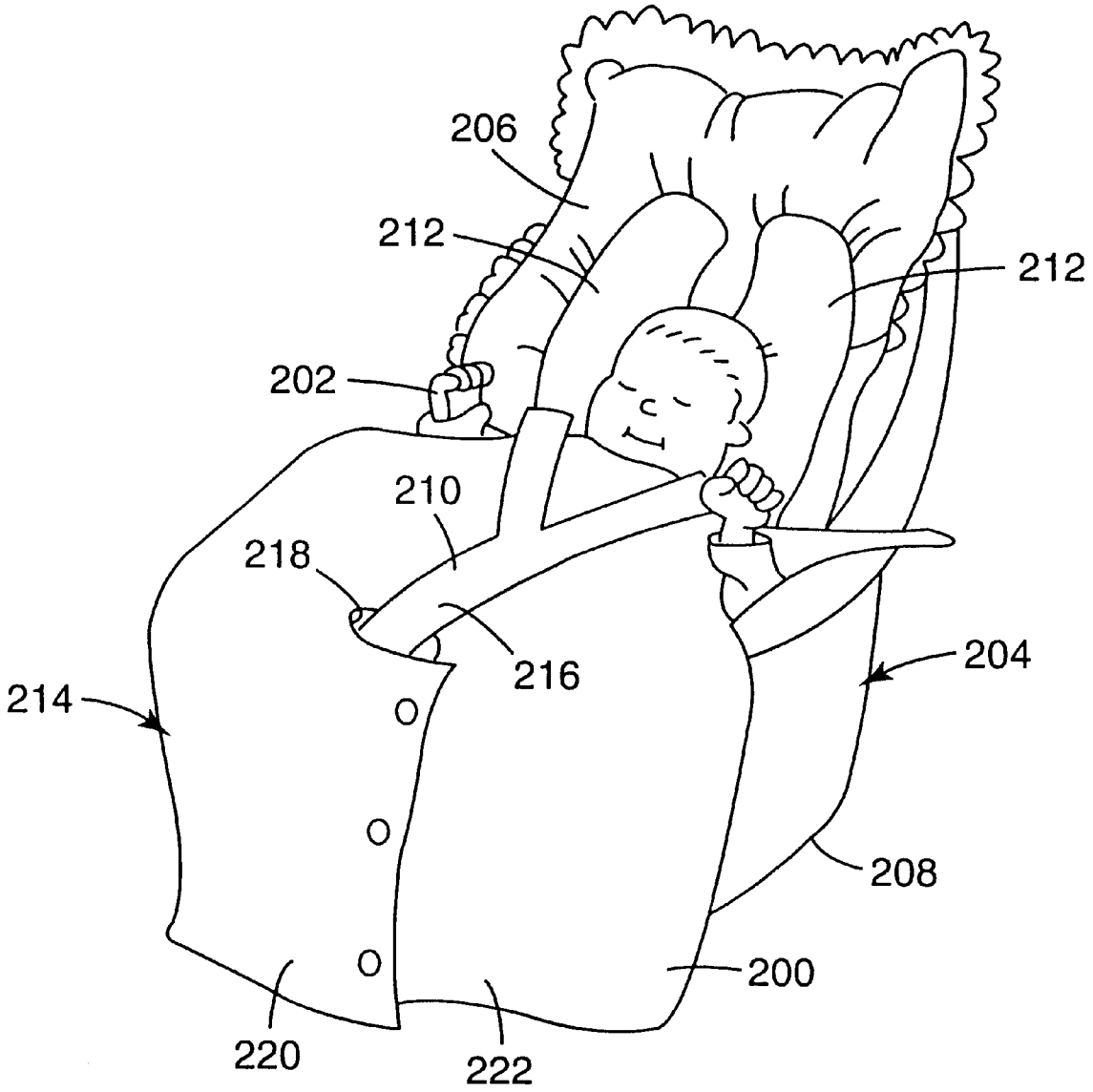
FIG. 20 is an embodiment of the present invention in which a baby blanket covers a child seated in a car seat.

FIG. 20 illustrates another embodiment of the present invention in which baby blanket 200 of the present invention covers child 202 seated in a supporting structure in the form of car seat 204. Car seat 204 includes padding 206 fitted into shell 208. Restraining belt apparatus 210 helps hold child 202 in seat 204. Neck pads 212 help support the child's neck. In order to keep child 202 warm and secure, blanket 214 curves around and covers child 202. A portion 216 of restraining belt apparatus 210 extends upward through throat aperture 218 of blanket 200. Flap 220 is secured to flap 222 in order to secure blanket 200 in position. Flap 220 and flap 222 are easily opened to allow blanket 200 to be positioned around, and removed from, restraining belt portion 216, as desired. Advantageously, blanket 200 can be positioned over child 202 and removed without having to lift child 202 out of high chair 204.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. A blanket of a size to be suitable for covering a child placed in a supporting structure of the type having an obstruction projecting generally upward from the supporting structure between the child's legs, said blanket comprising:

(a) a blanket panel having an interior region, a first major surface, a second major surface, and an outer perimeter;

(b) a through throat aperture positioned in the interior region of the blanket panel, wherein said throat aperture provides open communication between the first and second major surfaces of the blanket panel and is of a sufficient size to allow the obstruction to be positioned in the throat aperture in a manner such that the obstruction can pass through the throat aperture from one major surface of the blanket panel to the other; and (c) a channel extending from the through throat aperture to the outer perimeter of the blanket panel, wherein the channel has an open configuration and a closed configuration, wherein, in the open configuration, the channel provides open communication between the outer perimeter of the blanket panel and the throat aperture to allow the obstruction to be passed through the channel and positioned in the throat aperture, and wherein, in the closed configuration, open communication between the throat aperture and the outer perimeter is prevented such that when the channel is in the closed configuration and the obstruction is positioned in the throat aperture, the blanket is secured in place around the obstruction;

wherein the blanket is positionable to operatively engage the supporting structure and cover the child while the child is in the supporting structure and wherein the blanket curves over and covers the child while fitted around the obstruction.

2. The blanket of claim 1, wherein the channel is releasably openable and closable to change the configuration of the channel between the open and closed configurations.

3. The blanket of claim 1, wherein the channel defines first and second panel regions adjacent the channel, wherein the first panel region is releasably securable to the second panel in order to close the channel.

4. The blanket of claim 3, wherein the blanket further comprises first and second pocket forming flaps positioned on the first and second panel regions, respectively, in a manner effective to provide corresponding leg receiving pockets.

5. The blanket of claim 1, wherein the first panel region is releasably securable to the second panel by a fastening structure comprising cooperating fastening structure elements positioned on engaging portions of the first and second panel regions, respectively.

6. The blanket of claim 4, wherein the blanket panel comprises visually observable registration means to help registrably align at least one fastening structure element on the first panel region with a cooperating fastening structure element on the second panel region.

7. The blanket of claim 4, wherein the first panel region is releasably securable to the second panel by a fastening structure comprising cooperating hook and loop fastening means positioned on engaging portions of the first and second panel regions, respectively.

8. The blanket of claim 4, wherein the first panel region is releasably securable to the second panel by a buttoning structure comprising at least one cooperating button and button hole positioned on engaging portions of the first and second panel regions, respectively.

9. The blanket of claim 4, wherein the first panel region is releasably securable to the second panel by a zipper structure.

10. The blanket of claim 4, wherein the first panel region is releasably securable to the second panel by a fastening structure comprising at least one snap and snap receiver positioned on engaging portions of the first and second panel regions, respectively.

11. The blanket of claim 1, wherein the first panel region overlaps at least a portion of the second panel region when the channel is closed such that the first panel region comprises an overlapping portion and the second panel region comprises an overlapped portion.

12. The blanket of claim 10, wherein at least one releasable fastening structure element is positioned on the overlapping portion of the first panel region and a cooperating fastening structure element is positioned on the overlapped portion of the second panel region, said cooperating fastening structure elements being respectively positioned for operative engagement with each other.

13. The blanket of claim 11, wherein the fastening structure elements of the first and second panel regions comprise cooperating hook and loop fastening structure elements, respectively.

14. The blanket of claim 12, wherein the hook and loop fastening structure elements are button-shaped.

15. The blanket of claim 1, wherein the blanket panel has a circularly-shaped outer perimeter.

16. The blanket of claim 1, wherein the channel comprises at least one bend.

17. The blanket of claim 1, wherein the blanket comprises a relatively wide central body portion and at least one relatively narrow end portion.

18. The blanket of claim 1, wherein the blanket further comprises at least one securing member extending from the outer perimeter to allow the blanket to be secured to componentry associated with the child supporting structure.

19. A supporting structure for a child, comprising:

(a) a supporting surface on which the child can be placed;

(b) an obstruction projecting generally upward from the supporting structure, (c) a blanket, comprising (i) a blanket panel having an interior region, a first major surface, a second major surface, and an outer perimeter;

(ii) a through throat aperture positioned in the interior region of the blanket panel, wherein said throat aperture provides open communication between the first and second major surfaces of the blanket panel, said obstruction being positioned in the throat aperture in a manner such that the obstruction passes through the throat aperture from one major surface of the blanket panel to the other; and (iii) a channel extending from the through throat aperture to the outer perimeter of the blanket panel, wherein the channel has an open configuration and a closed configuration, wherein, in the open configuration, the channel provides open communication between the outer perimeter of the blanket panel and the throat aperture to allow the obstruction to be passed through the channel and positioned in the throat aperture, and wherein, in the closed configuration, open communication between the throat aperture and the outer perimeter is prevented such that when the channel is in the closed configuration and the obstruction is positioned in the throat aperture, the blanket is secured in place around the obstruction, and wherein the obstruction is positioned in the throat aperture and the channel is in the closed configuration;

wherein the blanket is positionable to operatively engage the supporting structure and to cover over and cover the child while the child is in the supporting structure and wherein the blanket curves over and covers the child while fitted around the obstruction.

20. The supporting structure of claim 19, wherein the seating device is a swing seat.

21. The supporting structure of claim 19, wherein the channel defines first and second panel regions adjacent the channel, wherein the first panel region is releasably securable to the second panel in order to close the channel.

22. The supporting structure of claim 21, wherein the first panel region is releasably securable to the second panel by a fastening structure comprising cooperating fastening structure elements positioned on engaging portions of the first and second panel regions, respectively.

23. The supporting structure of claim 21, wherein the blanket panel comprises visually observable registration means to help registrably align at least one fastening structure element on the first panel region with a cooperating fastening structure element on the second panel region.

24. The supporting structure of claim 21, wherein the first panel region is releasably securable to the second panel by a fastening structure comprising cooperating hook and loop fastening means positioned on engaging portions of the first and second panel regions, respectively.

25. The supporting structure of claim 21, wherein the first panel region is releasably securable to the second panel by a buttoning structure comprising at least one cooperating button and button hole positioned on engaging portions of the first and second panel regions, respectively.

26. The supporting structure of claim 21, wherein the first panel region is releasably securable to the second panel by a zipper structure.

27. The supporting structure of claim 21, wherein the first panel region is releasably securable to the second panel by a fastening structure comprising at least one snap and snap receiver positioned on engaging portions of the first and second panel regions, respectively.

28. The supporting structure of claim 21, wherein the first panel region overlaps at least a portion of the second panel region when the channel is closed such that the first panel region comprises an overlapping portion and the second panel region comprises an overlapped portion.

29. The supporting structure of claim 28, wherein at least one releasable fastening structure element is positioned on the overlapping portion of the first panel region and a cooperating fastening structure element is positioned on the overlapped portion of the second panel region, said cooperating fastening structure elements being respectively positioned for operative engagement with each other.

30. The supporting structure of claim 29, wherein the fastening structure elements of the first and second panel regions comprise cooperating hook and loop fastening structure elements, respectively.

31. The supporting structure of claim 30, wherein the hook and loop fastening structure elements are button-shaped.

32. The supporting structure of claim 21, wherein the blanket further comprises first and second pocket forming flaps positioned on the first and second panel regions, respectively, in a manner effective to provide leg receiving pockets.

33. The supporting structure of claim 19, wherein the blanket panel has a circularly shaped outer perimeter.

34. The supporting structure of claim 19, wherein the channel comprises at least one bend.

35. The supporting structure of claim 19, wherein the blanket comprises a relatively wide central body portion and at least one relatively narrow end portion.

36. The supporting structure of claim 19, wherein the blanket further comprises at least one securing member extending from the outer perimeter to allow the blanket to be secured to componentry associated with the child supporting structure.

37. The supporting structure of claim 19, wherein the supporting structure is a seating device and the obstruction comprises a post supporting a table member.

38. The supporting structure of claim 37, wherein the seating device is a high chair.

39. The supporting structure of claim 19, wherein the obstruction comprises a restraining bell apparatus.

40. The supporting structure of claim 19, wherein the supporting structure is a seating device adapted for transporting a child in a motor vehicle and wherein the obstruction comprises a safety belt apparatus capable of restraining the child in said seating device.

41. A method of covering a child with a blanket when the child is placed in a supporting structure of the type having an interfering obstruction, comprising the steps of:

(a) providing a blanket, comprising:

(i) a blanket panel having an interior region, a first side, a second side, and an outer perimeter;

(ii) a through throat aperture positioned in the interior region of the blanket panel, wherein said throat aperture provides open communication between the first and second sides of the blanket panel, said obstruction being positioned in the throat aperture in a manner such that the obstruction passes through the throat aperture from one side of the blanket panel to the other; and (iii) a channel extending from the through throat aperture to the outer perimeter of the blanket panel, wherein the channel has an open configuration and a closed configuration wherein, in the open configuration, the channel provides open communication between the outer perimeter of the blanket panel and the throat aperture to allow the obstruction to be passed through the channel and positioned in the total aperture, and wherein, in the closed configuration, open communication between the throat aperture and the outer perimeter is prevented such that when the channel is in the closed configuration and the obstruction is positioned in the throat aperture, the blanket is secured in place around the obstruction;

(b) while the blanket is in the open configuration, covering the child with the blanket in a mariner such that the obstruction is positioned in the throat aperture and such that the blanket curves over and covers the child, and (c) closing the channel to cause the channel to be in the closed configuration, whereby the blanket is secured in place around the obstruction.

42. The method of claim 41, wherein the channel defines first and second panel regions adjacent the channel, and wherein the closing step comprises releasably securing the first panel region to the second panel in order to close the channel.

43. The method of claim 42, wherein the first panel region is releasably secured to the second panel by a fastening structure comprising cooperating fastening structure elements positioned on engaging portions of the first and second panel regions, respectively.

44. The method of claim 43, wherein the blanket panel comprises visually observable registration means to help registrably align at least one fastening structure element on the first panel region with a cooperating fastening structure element on the second panel region.

45. The method of claim 42, wherein the first panel region overlaps at least a portion of the second panel region when the channel is closed such that the first panel region comprises an overlapping portion and the second panel region comprises an overlapped portion.

46. The method of claim 45, wherein the closing step comprises engaging at least one releasable fastening structure element on the overlapping portion of the first panel region with a cooperating fastening structure element on the overlapped portion of the second panel region.

47. The method of claim 46, wherein the fastening structure elements of the first and second panel regions comprise cooperating hook and loop fastening structure elements, respectively.

48. The method of claim 47, wherein the hook and loop fastening structure elements are button-shaped.

49. The method of claim 41, wherein the blanket panel has a circularly outer perimeter.

50. The method of claim 41, wherein the blanket comprises a relatively wide central body portion and at least one relatively narrow end portion.

51. The method of claim 41, wherein the blanket further comprises at least one securing member extending from the outer perimeter to allow the blanket to be secured to componentry associated with the child supporting structure, and the method further comprises securing the at least one securing member to said componentry.

* * * * *